US011198317B2

(12) United States Patent
Collath

(10) Patent No.: US 11,198,317 B2
(45) Date of Patent: Dec. 14, 2021

(54) PAPER CLIP SYSTEM WITH IMPROVED HOLDING CAPACITY

(71) Applicant: Christian Collath, Ingolstadt (DE)

(72) Inventor: Christian Collath, Ingolstadt (DE)

( * ) Notice: Subject to any disclaimer, the term of this patent is extended or adjusted under 35 U.S.C. 154(b) by 76 days.

(21) Appl. No.: 16/604,610

(22) PCT Filed: Mar. 29, 2018

(86) PCT No.: PCT/EP2018/058249
§ 371 (c)(1),
(2) Date: Oct. 11, 2019

(87) PCT Pub. No.: WO2018/188977
PCT Pub. Date: Oct. 18, 2018

(65) Prior Publication Data

US 2020/0101785 A1 Apr. 2, 2020

(30) Foreign Application Priority Data

Apr. 12, 2017 (DE) ..... 202017102210.2
Oct. 6, 2017 (DE) ..... 202017106081.0
(Continued)

(51) Int. Cl.
*B42F 1/00* (2006.01)
*B42F 1/08* (2006.01)

(52) U.S. Cl.
CPC ..... *B42F 1/08* (2013.01)

(58) Field of Classification Search
CPC ..... B42F 1/08
See application file for complete search history.

(56) References Cited

U.S. PATENT DOCUMENTS 2,665,463 A 1/1952 Aurynger
2,910,749 A * 11/1959 Parker ..... B42F 1/08 24/67.9
(Continued)

FOREIGN PATENT DOCUMENTS

CN 102225673 A 10/2011
DE 10138192 A1 2/2003
(Continued)

OTHER PUBLICATIONS

International Search Report dated Nov. 13, 2018 in parent International application PCT/EP2018/058249.
(Continued)

*Primary Examiner* — Jason W San
(74) *Attorney, Agent, or Firm* — Polson Intellectual Property Law, PC; Margaret Polson; Christopher Sylvain

(57) ABSTRACT

The invention relates to a paper clip system which consists of at least two paper clips (1) each having a large loop (2) and a small loop (3) that lies in the interior delimited by said large loop, and at least one connecting element, said connecting element being a sheath (11), comprising two flat extensive surfaces, into which each of the two paper clips (1) is inserted by one of their loops such that the two paper clips (1) are held in position by means of the sheath (11) with their remaining loop ready to clip an object to be held between said loop and the outer surface of the extensive surface of sheath (11) which faces same, wherein the two paper clip loops that are inserted into the same sheath are arranged so as to be separated and one above the other.

14 Claims, 14 Drawing Sheets

(30) Foreign Application Priority Data

Oct. 12, 2017 (DE) ..... 202017106188.4
Dec. 13, 2017 (DE) ..... 202017107590.7

(56) References Cited

U.S. PATENT DOCUMENTS 3,105,278 A * 10/1963 Sponsel ..... B42F 1/08 24/67.9
3,120,041 A * 2/1964 Voss ..... B42F 1/08 150/137
3,123,924 A 3/1964 Roberts
3,132,391 A * 5/1964 Steensland ..... B42F 1/08 24/67 R
3,225,469 A * 12/1965 Chase ..... B42F 21/00 40/641
3,408,700 A * 11/1968 Chase ..... B42F 1/08 24/67.3
3,913,181 A * 10/1975 Walker ..... B42F 1/08 24/67.9
4,480,356 A 11/1984 Martin
4,521,035 A * 6/1985 Berezowsky ..... B42F 1/00 24/555
4,665,594 A * 5/1987 Wagner ..... A44B 15/00 24/3.6
4,675,953 A * 6/1987 Higgs ..... A44C 1/00 24/499
5,481,784 A * 1/1996 Sinaiko ..... B42F 1/08 24/67 AR
5,484,126 A * 1/1996 Kitchin ..... B42F 1/08 248/217.3
5,553,363 A * 9/1996 Chen ..... A44B 9/14 24/353
5,887,900 A * 3/1999 Raymond ..... B42F 1/08 281/22
2002/0104199 A1* 8/2002 Chen ..... B42F 1/08 24/67.9
2004/0064920 A1* 4/2004 Arduini ..... B42F 1/08 24/67.9
2006/0107496 A1 5/2006 Cheng
2011/0258813 A1* 10/2011 Lu ..... B42F 1/08 24/67.9
2013/0205565 A1* 8/2013 Santos ..... B42F 1/02 29/428
2014/0090210 A1* 4/2014 Tillinghast ..... A45C 1/06 24/67.9
2014/0137391 A1* 5/2014 Beach ..... B42F 1/08 29/525.08
2014/0201952 A1* 7/2014 Windorski ..... B42F 1/08 24/67.11
2015/0007420 A1* 1/2015 Lusher ..... B42F 1/08 24/67.9
2016/0129721 A1* 5/2016 Balma ..... B42F 1/08 24/67.9

FOREIGN PATENT DOCUMENTS

DE 202005015770 U1 1/2006
EP 1577118 A1 9/2005
FR 2716744 A1 9/1995
WO 8101535 A1 6/1981

OTHER PUBLICATIONS

Written Opinion of the International Searching Authority dated Oct. 22, 2018 in parent International application PCT/EP2018/058249.

* cited by examiner

PAPER CLIP SYSTEM WITH IMPROVED HOLDING CAPACITY

TECHNICAL BACKGROUND

Paper clips in a wide variety of shapes and sizes have been in use for many years.

The most common are paper clips that are made of a bent wire. Paper clips that are stamped from a thin metal sheet or are made of plastic are less common and are not referred to again separately below, even though naturally they can in principle be used for the system according to the invention.

The capacity, i.e. how many sheets of paper or other items a paper clip can respectively hold together, varies within wide limits. The capacity is highly dependent on the size of the paper clip and on its wire thickness.

Such paper clips cause problems particularly when it is a natter if holding together different stacks of associated papers.

One option in this connection has been to provide each individual paper stack with a small paper clip and then hold the plurality of such paper stacks together with another paper clip.

But when doing so, the different paper clips easily become caught in one another and may then be inadvertently pulled off so that the organization of the papers initially achieved by means of the paper clips gets mixed up in the worst case or at any rate, the user must pay very close attention, which makes handling extremely inconvenient.

Difficulties also occur if the user only has paper clips of a single type or capacity on hand and wishes to hold together paper stacks or items that exceed the capacity of the respective individual paper clips.

Paper clips in a wide variety of shapes and sizes have been in use for many years. The most common are paper clips that are made of a bent wire. The capacity, i.e. how many sheets of paper or other items a paper clip can respectively hold together, varies within wide limits. The capacity is highly dependent on the size of the paper clip and on its wire thickness.

When it is necessary to hold together several different stacks of associated papers together, each individual paper stack must be provided with a small paper clip and then these stacks are held together with another paper clip. But when doing so, the different paper clips can become caught in one another and then be inadvertently pulled off so that the organization of the papers initially achieved by means of the paper clips gets mixed up in the worst case or at any rate, the user must pay very close attention, which makes handling extremely inconvenient.

Difficulties can also occur if the user only has paper clips of a single type or capacity on hand and wishes to hold together paper stacks or items that exceed the capacity of the respective individual paper clips.

Furthermore, paper clips are usually stored loose in a storage box and the paper clips in this loose arrangement can become caught in one another. If a user then wishes to take a paper clip out of the storage box, then it happens very frequently that several paper clips are pulled out of the storage box. The user must then manually separate the paper clips provided for use from the other paper clips, which is time-consuming and sometimes inconvenient.

The Problem Underlying the Invention

In light of this situation, the object of the invention is to create a system, which, without the need for using paper clips with significantly different clipping force and/or clipping capacity, can hold together larger quantities of paper than a single paper clip of the system, and also to create a system, which makes it possible to securely hold together different stacks of respectively associated papers without the occurrence of an unwanted catching.

The Solution According to the Invention

A paper clip system is proposed as a solution, which consists of at least two paper clips positioned directly on top of each other in equidirectional fashion (i.e. with the same orientation and entirely or at least essentially superposed with each other in projection). The paper clips belonging to the system each have a large loop and a small loop that is entirely or in any case essentially positioned in the inner region that is enclosed by this large loop. In addition to the at least two paper clips, for every two paper clips, the system consists of a connecting element that connects these loops to one another.

In other words, the system according to the invention features the fact that in addition to the at least two paper clips—which do not transition integrally into one another, but are physically separate from each other—the system includes a connecting element that holds onto the small loop of the one paper clip in the region that is enclosed by the large loop of the other paper clip and on the one side of the loops positioned one inside the other, across their longitudinal broad side, there is a free large loop of the one paper clip and on the other side of the loops positioned one inside the other, across their longitudinal broad side, there is a free small loop of the other paper clip.

Other embodiment possibilities, functions, and advantages ensue from the following description of the exemplary embodiments based on the figures.

As a further solution, a paper clip system is advantageously proposed, which consists of at least two paper clips positioned directly on top of each other in equidirectional fashion (i.e. with the same orientation and entirely or at least essentially superposed with each other in projection). The paper clips belonging to the system advantageously each have a large loop and a small loop that is entirely or in any case essentially positioned in the inner region that is enclosed by this large loop. In addition to the at least two paper clips, for every two paper clips, the system consists of a connecting element that connects these loops to one another.

The connecting element is advantageously embodied as a sheath with two large surfaces that are flat, i.e. essentially intrinsically planar on the inside and outside, generally in the form of a tube that has been pressed flat. One of the loops of each of the two paper clips is inserted into the interior enclosed by this sheath in such a way that the two paper clips are held in position by the sheath so that their other loop is ready to clip an item that is to be held between it and the outer surface of the large surface of the sheath facing it. A large surfaces is essentially intrinsically planar if a loop of one paper clip can rest completely against it, it being harmless if there are points of purely local lack of contact.

In this connection, the two loops of the paper clips that are inserted into one and the same sheath are positioned one on top of and separate from each other. This is because since each of the two paper clips, whose respective loop is inserted into the sheath, clamps a large surface between its loops, the two loops inserted into the sheath are not nested in each other inside this sheath. Instead, they are positioned on top of each other "like stories of a building" and as a rule, are separated from each other by an imaginary (hypothetical) separating plane, which extends parallel to the longitudinal axis of the sheath. One of these loops rests completely against one side of the imaginary separating plane while the other loop rests completely against the opposite side of the imaginary separating plane. This prevents or makes it significantly harder for the respective loops of the paper clips that are positioned in one and the same sheath from catching on each other. This achieves a paper clip system whose interconnection can be easily produced and detached again.

BRIEF DESCRIPTION OF THE DRAWINGS

The below description references the accompanying drawings, wherein:

FIGS. 3 to 5 show the first exemplary embodiment, wherein FIG. 3 shows a perspective view with one paper clip, FIG. 4 shows a perspective view onto the other side thereof, and FIG. 5 shows the configuration of FIG. 3 with a second paper clip;

FIGS. 8 to 10 show the second exemplary embodiment, wherein FIG. 8 shows a perspective view with one paper clip, FIG. 9 shows a perspective view onto the other side thereof, and FIG. 10 shows the configuration of FIG. 8 with a second paper clip;

FIGS. 11 and 12 show the third exemplary embodiment, wherein FIG. 11 shows a perspective view with one paper clip and FIG. 12 shows the configuration of FIG. 11 with a second paper clip;

FIGS. 13 to 17 show the fourth exemplary embodiment, wherein FIG. 13 shows a perspective view of two paperclips indicating insertion into a sheath, FIG. 14 shows a side view of the paperclips inserted into the sheath with paper stacks, FIG. 15 shows an opposite side view thereof, FIG. 16 shows a perspective view of the paperclips inserted into the sheath, and FIG. 17 shows another perspective view thereof;

FIGS. 18 to 20 show the fifth exemplary embodiment, wherein FIG. 18 shows a perspective view with two paper clips, FIG. 19 shows a side view thereof with paper stacks, and FIG. 20 shows a perspective view with one paper clip;

FIGS. 33 to 36 show the fifteenth exemplary embodiment, wherein FIG. 33 shows one paper clip in perspective, FIG. 34 shows two paper clips in perspective, FIG. 35 shows the two paper clips form the side, and FIG. 36 shows the two paper clips from another perspective;

FIGS. 37 to 39 show another embodiment, wherein FIG. 37 shows a perspective view of the first paper clip, FIG. 38 shows an alternative design thereof, and FIG. 39 shows a perspective view of a second paper clip which, together with the paper clip of FIG. 37 or FIG. 38, forms a paper clip system.

DETAILED DESCRIPTION

Figure 1:
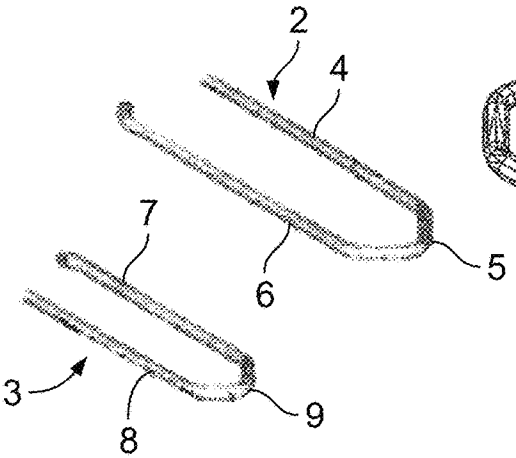
FIG. 1 shows an exploded perspective view of a double loop paper clip.
Figure 2:
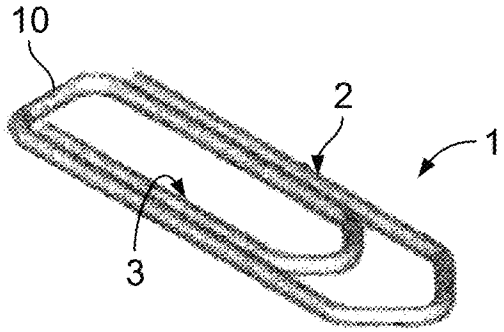
FIG. 2 shows a non-exploded view of the paper clip of FIG. 1.

FIG. 2 and the associated exploded view in the form of FIG. 1 show a double loop paper clip of the generally known type.

Preferably, the paper clip system according to the invention is based on such a paper clip.

As is the most readily apparent based on the sectional, pulled-apart depiction in FIG. 1, such a paper clip 1 consists of a large loop 2 and a small loop 3.

The large loop 2 consists of two legs 4 and 6, which constitute the long sides of the loop 2. The two legs 4 and 6 are integrally connected to one another by means of a tip 5—preferably at the front narrow end of the loop. The tip 5 is preferably embodied as triangular, as shown in FIG. 1, but can alternatively also be uniformly rounded or be embodied in the form of two 90° bends with a straight connecting piece, i.e. quasi-rectangular. The long sides of the loops are generally longer than the narrow ends of the loops.

The small loop 3 consists of two legs 7 and 8, which are integrally connected to each other by means of a tip 9. Statements above regarding the tip 5 also apply to the tip 9, as do statements above regarding the narrow ends and long sides.

As is the most readily apparent in FIG. 2, the two loops 2 and 3 are connected to each other at their narrow end oriented away from the tips 5 and 9 by a connecting section 10—in such a way that the small loop 3 is positioned in the interior enclosed by the large loop 2 of the same paper clip 1 and lies essentially in the same plane with the large loop 2. The two loops are generally positioned one inside the other so that the outsides of the two legs 7, 8 of the small loop 3 touch the insides of the legs 4, 6 of the large loop 2, at least essentially.

The paper clips in question here are generally embodied of one piece. They are usually made of wire that is preferably passivated, i.e. galvanized, varnished, or coated with plastic. The wire typically has a diameter of between 0.3 mm and 1.5 mm.

The following should be noted about the reference numeral system:

The suffix "0.1" or "0.2" indicates whether the region mentioned is located on the first or second paper clip of the system. Thus, for example, the connecting section between the small loop and the large loop of one and the same paper clip is generally labeled with the reference numeral 10. If the relevant connecting section on the first paper clip is being mentioned, then it is labeled "10.1." On the second paper clip, this connecting section is labeled "10.2."

First Exemplary Embodiment

The Paper Clips Used for the System

Figure 4:
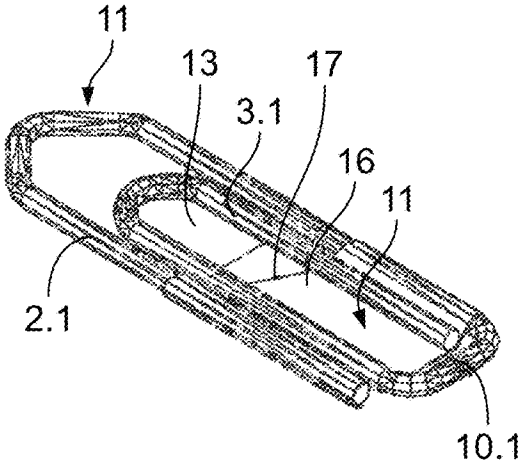
Figure 3:
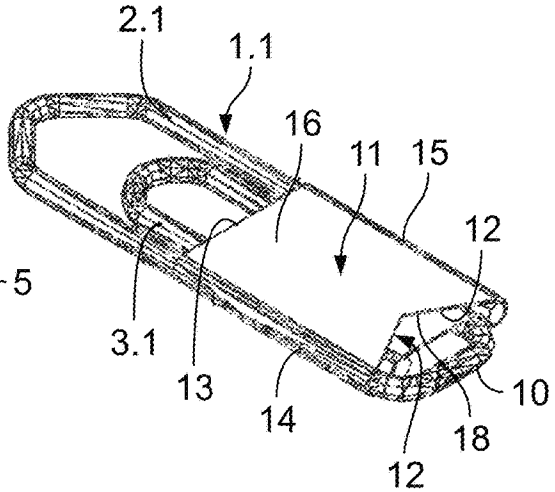
Figure 5:
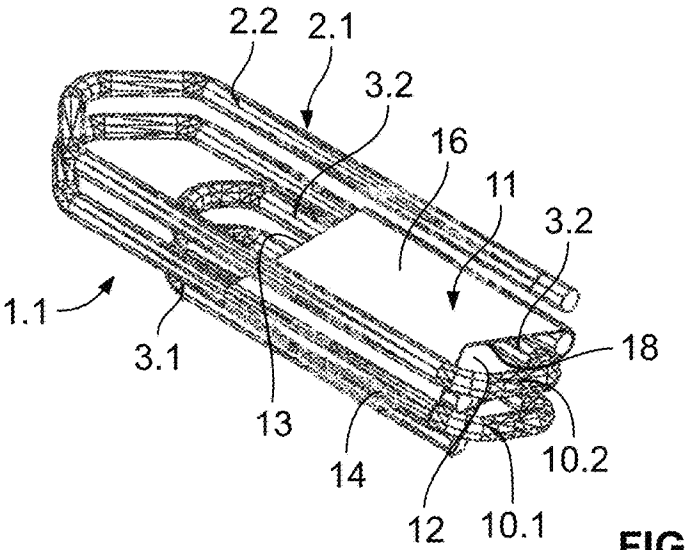

FIGS. 3 to 5 show the first exemplary embodiment of the paper clip system according to the invention.

The first exemplary embodiment of the invention is formed using at least two paper clips 1.1 and 1.2 of the type explained above based on the paper clip 1.

The two paper clips 1.1, 1.2 are preferably used as is, i.e. they are not—or not significantly—plastically deformed relative to their original state.

First, the large loop 2.1 of the first paper clip is inserted into the interior of the sheath 11 through the open narrow end 12 of the sheath 11 as shown in FIG. 3. The small loop 3.1 of the first paper clip then comes to rest against the outside of the lower large surface 16 of the sheath 11 in the present FIG. 3.

FIG. 4 shows this in greater detail; FIG. 4 is a view of the configuration from FIG. 3, but seen from below.

In order to complete the system, the small loop 3.2 of the second paper clip is then inserted into the sheath 11 so that the configuration shown in FIG. 5 is produced. In this configuration, the system is ready for clipping as follows:

The small loop 3.1 of the first paper clip can clip an item, in particular one or more sheets of paper, between itself and the lower large surface 16 of the sheath 11.

The large loop 2.2 of the second paper clip can clip an item, in particular one or more sheets of paper, between itself and the upper large surface 16 of the sheath 11.

If the capacity of the system is not yet sufficient, then it can be expanded as needed. For example, one or both of the loops 2.2 and 3.1 of the paper clips positioned outside the sheath 11 are inserted into other sheaths of the same type, not shown here, in order to continue extending the system always according to the same pattern until it has reached the desired capacity. The sheaths 11 in this case can also be preinstalled and clamped to the paper clip. One possibility for the clamping is to crimp or crimp-over the part of the sheath where the sheath protrudes beyond the free end of a leg of the paper clip. Alternatively, it can also be glued, heat-shrunk, or knurled. The intent of this is to prevent the sheath from moving on the paper clip.

The Connecting Element Embodied as a Sheath

The system of this exemplary embodiment, as already mentioned, includes not only the two paper clips 1.1 and 1.2, but also the connecting element embodied as a sheath 11 whose preferred design details will be described below.

The sheath 11 is adapted to the contour of the paper clips 1.1 and 1.2 that are used.

As indicated in detail in FIG. 3, it has an open narrow end 12, a closed or preferably likewise open narrow end 13, longitudinal narrow sides 14 and 15, and two large surfaces of which only the upper large surface 16 is visible in FIGS. 3 and 5 because the other large surface is on the underside. This other large surface, however, is shown in FIG. 4.

The sheath 11 here is dimensioned so that the two loops of the two paper clips can be accommodated in the sheath independently of each other without having to insert a loop into the inner region enclosed by the other loop. This achieves the decisive advantage that the two loops positioned directly next to each other on the inside of the sheath 11 do not become caught in each other or hinder each other when being slid into the sheath or pulled out of it.

The inner cross-section of the sheath 11 is dimensioned correspondingly. It preferably corresponds approximately to a rectangle whose long sides respectively correspond in length to the maximum distance of the two large legs of a paper clip and whose short sides correspond in length approximately to twice the wire thickness of the paper clips belonging to the system, possibly with a tolerance of max. ⅓ of a wire diameter of the paper clips belonging to the system. The same applies analogously to an oval cross-section or an elliptical cross-section with regard to its major axis and minor axis.

In other embodiments, the inner cross-section of the sheath is deliberately dimensioned to be larger. In this case, the above-mentioned rectangle is dimensioned so that its long sides once again respectively correspond in length to the maximum distance between the two large legs of a paper clip. Its narrow ends, however, are embodied as longer or higher. They correspond in length to twice the wire thickness of the paper clips belonging to the system plus an additional height of 5/10 to 12/10 of a wire diameter of the paper clips belonging to the system.

The sheath can consist of different materials. For example, it is conceivable to produce the sheath as a correspondingly pressed-flat tube made of a rigid material, for example metal or a rigid plastic.

It has turned out to be ideal, however, to produce the sheath out of a thick-walled plastic tube, with a wall thickness of approx. 0.5/10 mm to maximal 12/10 mm or better still, only up to a maximum of 8/10 mm. A plastic tube of this kind can not only be easily processed, for example brought into the appropriate shape by applications of hot air; it is also very advantageous that it is also inherently accompanied by a not inconsiderable flexibility. This makes it easy to insert the loops of the paper clips into the sheath 11 formed by it, above all if the user is to expand the paper clip system at the moment when it is already holding papers or other items.

The sheath 11 can be affixed to the loop of the paper clip in that its two main surfaces in the region between the two legs of the loop, namely at or near the tip, are pressed together and glued or welded to each other, which is not graphically depicted here.

Preferably, the sheath has an open second narrow end 13, as already mentioned above. For example, it can be very easily cut from an endless extruded tube.

In other cases, the sheath is closed at the second narrow end 13. The inside of this narrow end can then optionally correspond to the contour of the tip 5 of a large loop 2 of the paper clips 1 that are to be used in the system. It then provides a reinforced hold for the large loop.

It has turned out to be particularly advantageous if at the end—i.e. at a narrow end and on a main surface, ideally the lower main surface—the sheath has a single bevel 17, as is readily apparent in FIG. 4, in which the single bevel 17 is provided on the narrow end 13, i.e. the narrow end provided with such a bevel 17 is preferably the one that points toward the tip of a paper clip in the finally assembled state. This bevel 17 makes it easier to attach the relevant paper clip or system to a paper stack or stack of items to be held. Alternatively, a double bevel can also be present here.

It turns out to be particularly advantageous if at the end—i.e. at a narrow end and on a main surface, ideally the upper main surface—the sheath has a double bevel 18, as is readily apparent in FIGS. 3 and 5. The narrow end 12 provided with such a double bevel 18 is preferably the narrow end diametrically opposite from the narrow end provided with a single bevel 17. This means that ideally, the one large surface 16 of the sheath 11 has a single bevel 17 at the one narrow end 13 and the other large surface 16 of the sheath 11 has a mostly double bevel 18 at the other narrow end 12, as can be easily imagined based on a combined consideration of FIGS. 4 and 5. Alternatively, a single bevel can also be present here.

For some applications, it can be advantageous to provide the above-mentioned bevels at both of these main surfaces.

Instead of or in addition to the bevel or bevels, it is also possible at the narrow end of a main surface for the material of the sheath to be crimped outward in order to ensure an easier insertion of the other paper clip.

Figure 7:
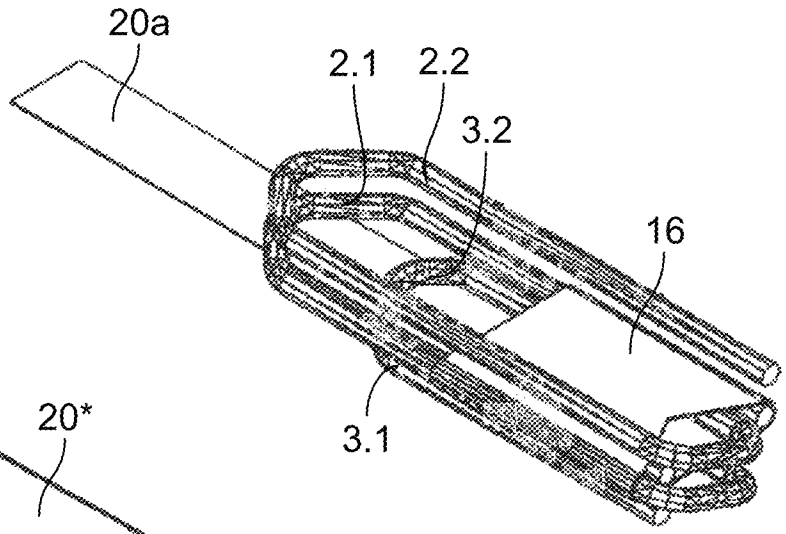
FIGS. 6 and 7 show perspective views of paper clips with modified sheaths.
Figure 6:
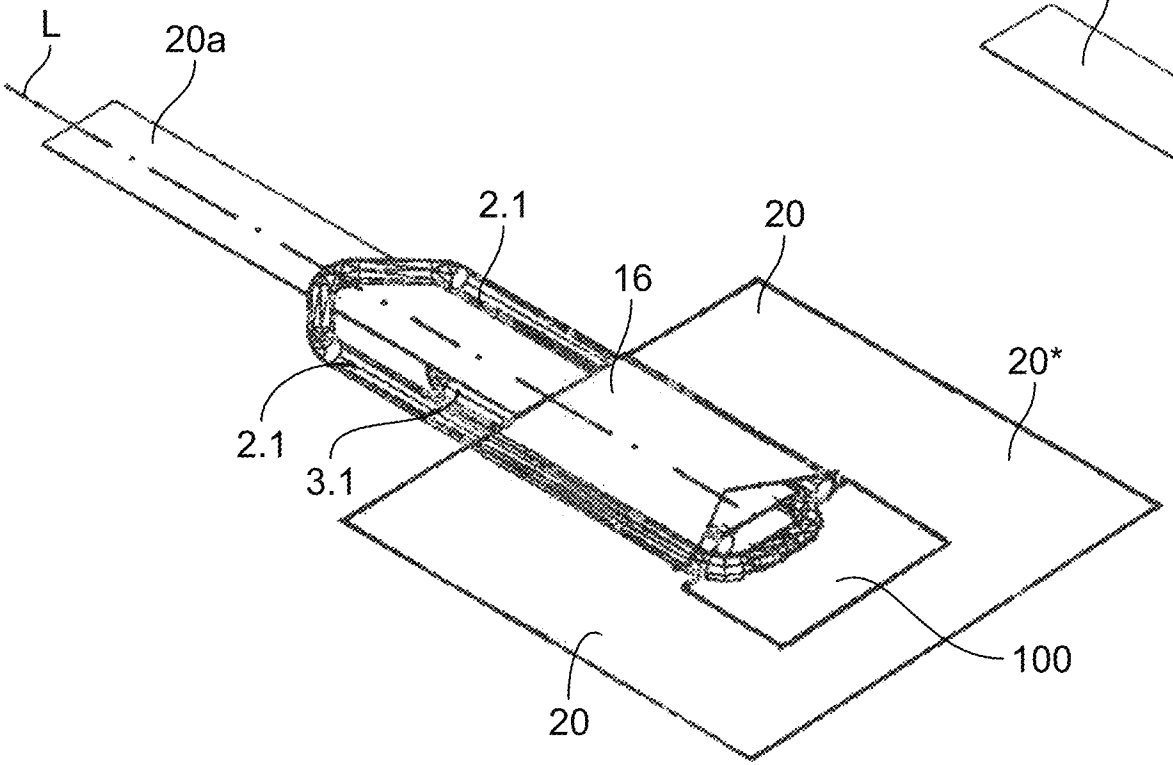

It should also be noted that the sheath 11 for the paper clip system can, if need be, also be modified, particularly in the way shown in FIG. 6 and FIG. 7.

In order to achieve an improved support on the paper stack being held, the sheath 11 in this case can optionally and preferably be provided with fins or support surfaces 20 on both sides, which extend away from it transversely to the longitudinal axis L of the sheath 11. These fins or support surfaces 20 prevent the papers, which are held under the support surfaces between the sheath 11 and the loop of the respective paper clip there, from slipping out of the clip's grasp too easily.

The holding effect can be improved by means of a self-adhesive function provided on one or preferably more support surfaces or by means of a friction-increasing coating or fluting of the support surfaces.

In addition or instead, the sheath can also be equipped with a tongue 20*a*, which protrudes from the sheath 11 in the direction of the longitudinal axis L of the sheath.

Such a tongue 20*a* makes it easier to detach individual papers or objects from the packet being held by the system. This is because with a corresponding pull on the tongue 20*a*, the relevant sheath 11 can be easily pulled off of the paper clips so that the packet comes apart.

In addition, at least one support surface 20 can have an extension 20*, which protrudes outward for example from the outside of the sheath in the direction of the longitudinal axis L of the sheath and so provides an index or tab, which facilitates clear organization of the papers that are held clipped by the system. In the region in which the support surface laterally next to the paper clip transitions into the extension 20*, the extension 20* is preferably provided with a window-like cutout 100. This ensures that it is possible to insert a paper clip unhindered into the sheath 11, see FIG. 6.

In general, it is particularly favorable if at least one large surface 16 of the sheath 11 and/or one fin 20 and/or the tongue 20*a* and/or the extension 20* can be printed on or written on. It is therefore very easy to provide it with advertising. In addition, this significantly facilitates organization since the user can, for example, use the extensions 20* as tabs that are individually labeled by him, which facilitate orientation in the stack that is clipped by the paper clip system.

Other embodiment possibilities for the sheath ensue from the following description of additional exemplary embodiments.

Second Exemplary Embodiment

Figure 10:
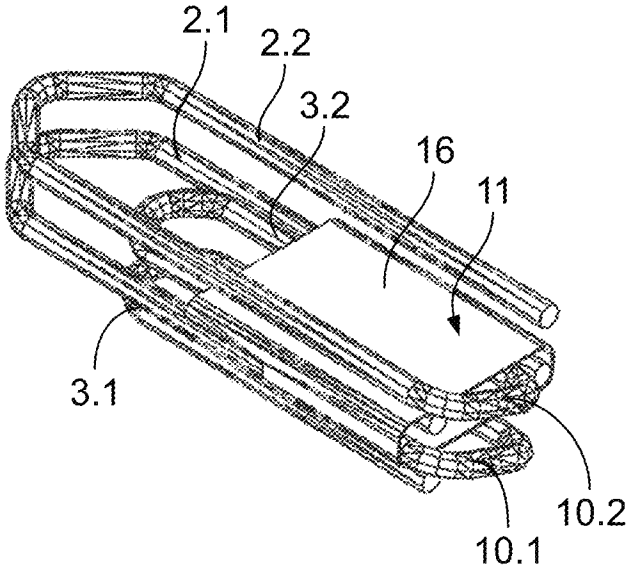
Figure 9:
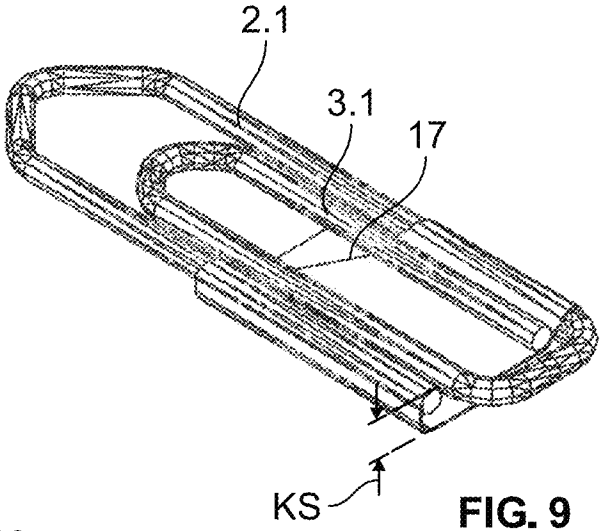
Figure 8:
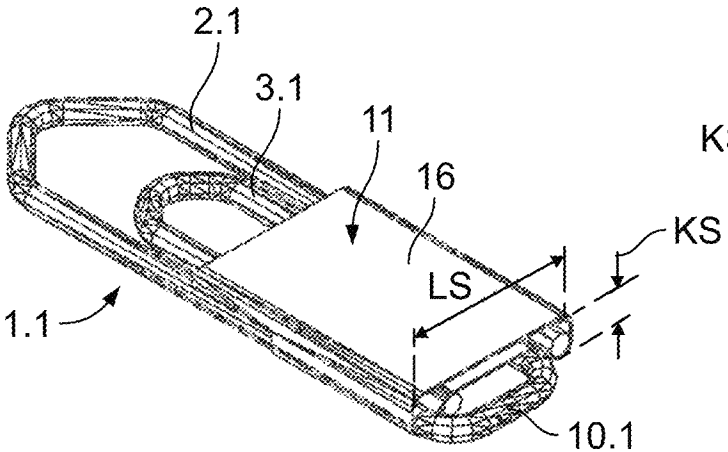

The second exemplary embodiment shown in FIGS. 8 to 10 is a slight modification of the first exemplary embodiment. Therefore statements made above with regard to the latter also apply without restriction to the second exemplary embodiment. The modification consists of the fact that the inner cross-section of the sheath is deliberately dimensioned to be larger, as already mentioned above.

In FIGS. 8 to 10, this rectangle, which indicates the inner cross-section of the sheath 11 in the unloaded state, is dimensioned so that its long sides LS once again respectively correspond in length to the maximum distance of the two large legs of a paper clip. Its narrow sides KS, however, are embodied as longer or higher. They correspond in length to twice the wire thickness of the paper clips belonging to the system plus an additional height of 5/10 to 12/10 of a wire diameter of the paper clips belonging to the system, in particular see FIG. 8.

Third Exemplary Embodiment

Figure 12:
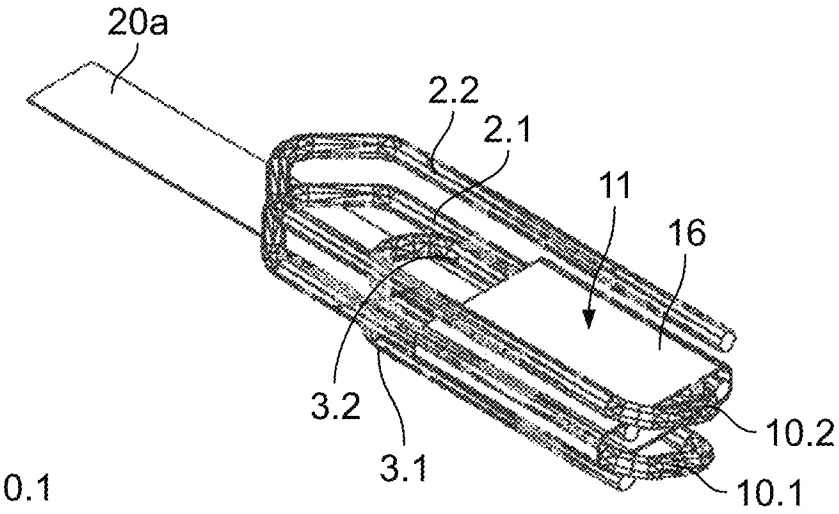
Figure 11:
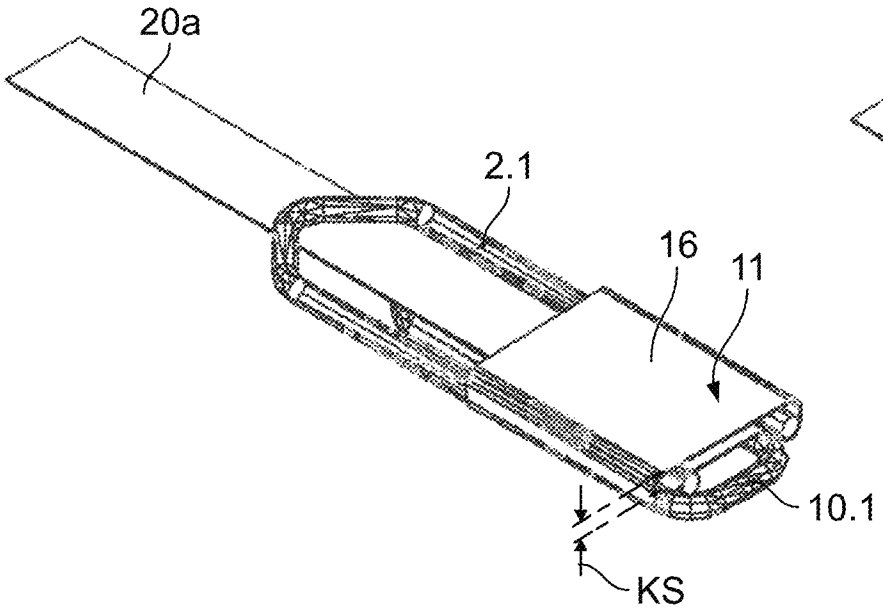

The third exemplary embodiment shown by FIGS. 11 and 12 is a modification of the second exemplary embodiment. Therefore statements made above with regard to the latter also apply without restriction to the third exemplary embodiment.

In this case, the modification is achieved by providing an additional tongue 20*a* of the kind that has already been described in detail above. In addition or instead, in this exemplary embodiment as well, fins or support surfaces or extensions (tabs) are provided, which are not shown here, as also already mentioned above.

Fourth Exemplary Embodiment

The Paper Clips Used for the System

The fourth exemplary embodiment of the invention is formed using two paper clips 1.1' and 1.2' of the type explained above (FIGS. 1 and 2) based on the paper clip 1.

The two paper clips 1.1', 1.2' are preferably used as is, i.e. they are not—or not significantly—plastically deformed relative to their original state.

Figure 13:
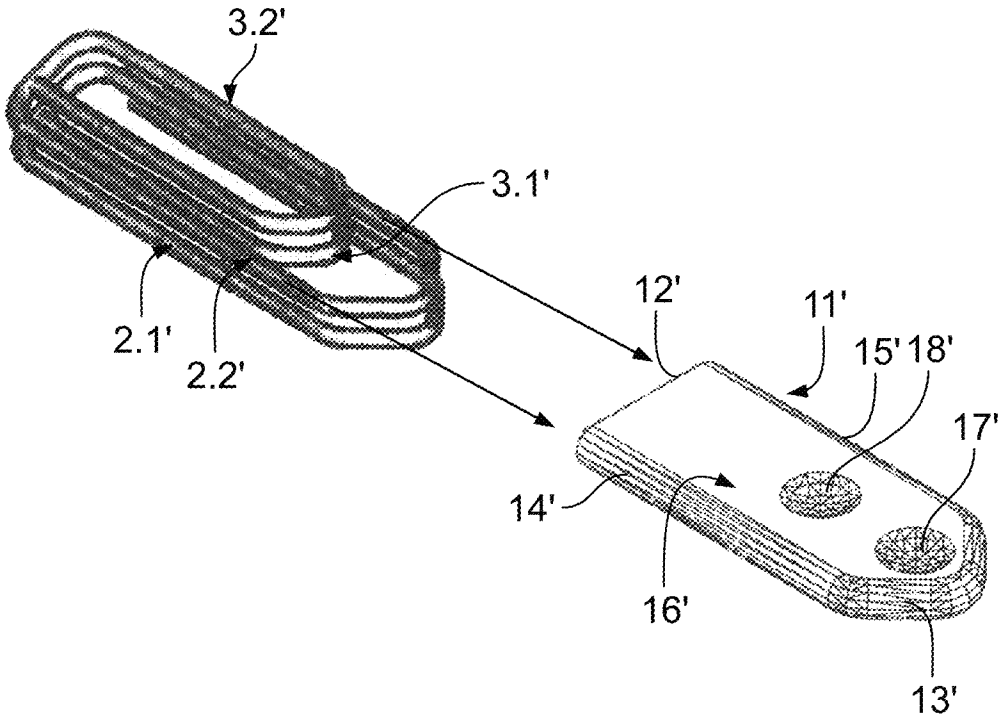

The two paper clips 1.1' and 1.2' can be placed one on top of the other as shown in FIG. 13.

They are then joined together with the sheath 11'. In this case, the small loop 3.1' of the lower paper clip 1.1' comes to lie in the same plane as the large loop 2.2' of the upper paper clip 1.2', namely inside this large loop 2.2'. In other words, after the insertion into the sheath, the smaller loop 3.1' of the paper clip 1.1' at least essentially is positioned completely inside the space and plane that is delimited and defined by the large loop 2.2' of the upper paper clip 1.2'.

For the sake of completeness, it should be noted that the assembly explained only in principle above is in practice preferably performed so that the large loop 2.1' of a second paper clip is inserted into the sheath 11' and then the unit thus formed is slid onto a sheet of paper, which is held clipped between the small loop 3.1' of this paper clip and the sheath. Then the small loop 3.2' of a second paper clip is inserted into the sheath and the large loop of the first paper clip contained therein so that this small loop in the middle of this large loop in the manner that has already been described above. The large loop 2.2' in this case comes to rest against the outside of the previously still free large surface of the sheath 11'. Then, one or more sheets of paper can be clipped between the loop 2.2' and the sheath.

The Connecting Element Embodied as a Sheath

The system of this exemplary embodiment, as already mentioned, includes not only the two paper clips 1.1' and 1.2', but also the connecting element embodied as a sheath 11' whose preferred design details will be described below.

The sheath 11' is adapted to the contour of the paper clips 1.1' and 1.2' that are used.

It has an open narrow end 12', a closed narrow end 13', longitudinal narrow sides 14' and 15, and two large surfaces, of which only the upper large surface 16' is visible in FIG. 13 because the other large surface is on the underside.

Preferably, the sheath has a closed narrow end 13', which at least on the inside corresponds to the contour of the tip 5 of a large loop 2' of the paper clips 1' that are to be used in the system and therefore provides a reinforced hold for these large loops.

As part of a modification that is not graphically depicted here, the sheath does not have a tip, i.e. it is "cut-off" so to speak. The sheath then constitutes a flat tube, in anticipation, also see FIG. 24.

A complete, preferred—as described above—successive insertion of the two paper clips into the sheath 11' of the type shown in FIG. 2 then results in an ensemble of the kind that is shown in FIGS. 14 to 17.

Figure 14:
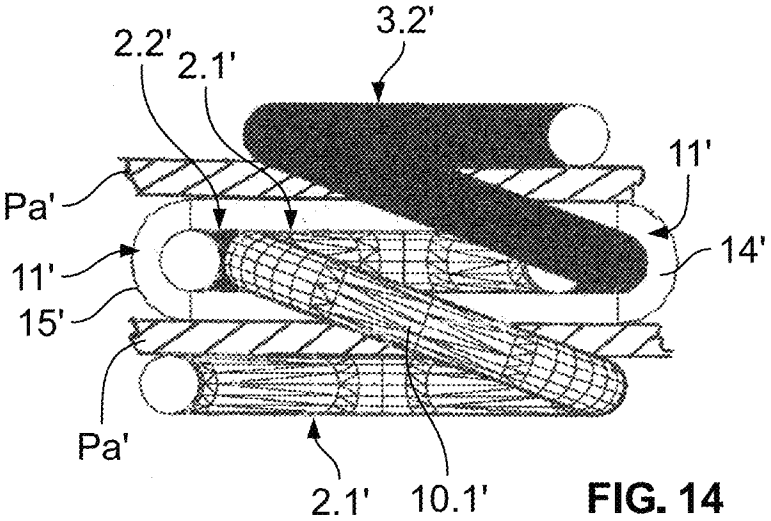

First and foremost, FIG. 14 should be mentioned here as being very demonstrative.

It is clear how the black-colored large loop 2.2' of the upper paper clip 1.2' has come to rest together with the small loop 3.1' of the lower paper clip 1.1' almost completely in the sheath 11', usually protruding only a short distance out from it, preferably by less than ⅓ the length of each paper clip in the direction of its legs.

It is also clear how the black-colored small loop 3.2' of the upper paper clip 1.2' in this case—forced by the thickness of the paper or papers Pa' being held—has come to rest against or (here, in action) spaced apart above the upper large surface of the sheath. It is also clear that the large loop 2.1' of the lower paper clip has correspondingly come to rest against or, under the influence of the paper or papers Pa' being clipped against the lower large surface of the sheath.

The two above-mentioned loops 3.2' and 2.1' are thus available—whether this be for clipping and holding one or more sheets of paper between themselves and the sheath or for use as another connecting element for a corresponding concatenation, e.g. by means of another such sheath and another such paper clip.

Figure 15:
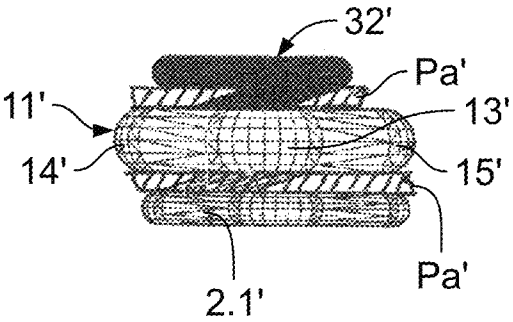

The situation is also very clear from FIG. 15. Here, for the sake of clarity, the upper paper clip 3.2' has been colored black.

FIG. 15 shows the above-mentioned situation, viewed from the closed narrow end 13' of the sheath 11'. The paper stacks Pa' are also clearly shown.

Figure 16:
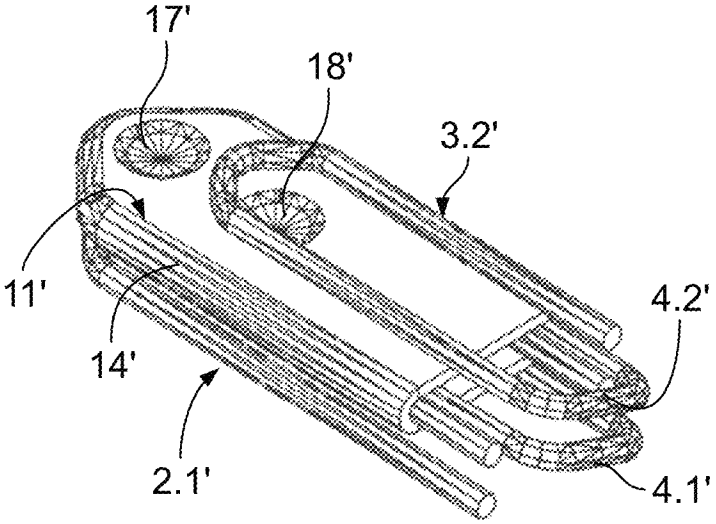
Figure 17:
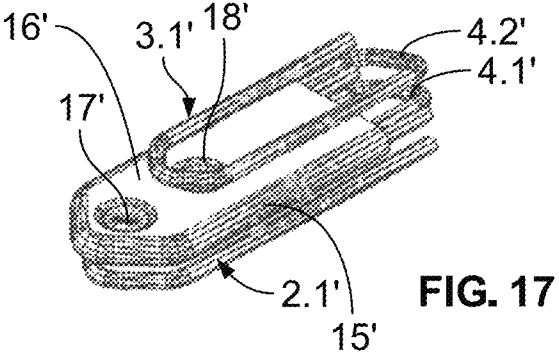

FIGS. 16 and 17 provide a further depiction of the same situation; in this case, the free small loop 3.2' and the free large loop 2.1' preferably rest against the respective large surface of the sheath where they are ready for clipping.

OTHER EMBODIMENT POSSIBILITIES FOR THE SHEATH

Preferably, the inner cross-section of the sheath is embodied so that it essentially corresponds to the width and/or height of the large loop of the paper clips that properly constitute components of the paper clip system. The embodiment is ideally so that at least the relevant large loop is positioned with a frictional and/or form-fitting hold between at least two—or better still 2×2—opposing inner surfaces of the sheath.

The detent mechanism or—preferably—detent mechanisms 17' and 18' on the sheath 11' are worth noting.

As is readily apparent from FIGS. 13, 16, and 17, the detent mechanism or detent mechanisms 17', 18' are preferably embodied as recesses, which preferably extend inward in plate-like or lens-like fashion from the outer surface of the large surface 16' of the sheath 11' so that on the inside of the large surface 16' of the sheath, corresponding detent projections, e.g. detent studs or detent bumps.

Such detent mechanisms 17', 18' can be affixed to only one large surface 16' or to both opposing large surfaces, possibly also on one or both longitudinal narrow sides 14' and 15' of the sheath with a corresponding embodiment of the legs 4', 6', 7', and/or 8', in order to achieve a frictional and/or form-fitting engagement. In this connection, it is particularly advantageous if the sheath consists of plastic since as the respective loop is being slid into place, it can push apart and slide past the detent projection or detent projections until it or they spring back into position behind the loop and engage in detent fashion. It is particularly advantageous if in this connection, paper clips with a triangular or possibly also round tip are used, which makes it easier to push apart and slide past the detent projection or detent projections.

As is readily apparent, for example from FIG. 16, when the upper paper clip has been inserted all the way, the detent mechanism 17' fits into the region on the inside of the tip of the large loop 2.2'. The detent mechanism 18' fits into the region on the inside of the tip of the small loop 3.1' in an analogous fashion. If only one detent mechanism is provided, then preferably, the detent mechanism 18' is embodied for the small loop. This is because as soon as this is detent-engaged in a form-fitting manner, it simultaneously holds the large loop that is caught between it and the sheath 11'.

Figure 21:
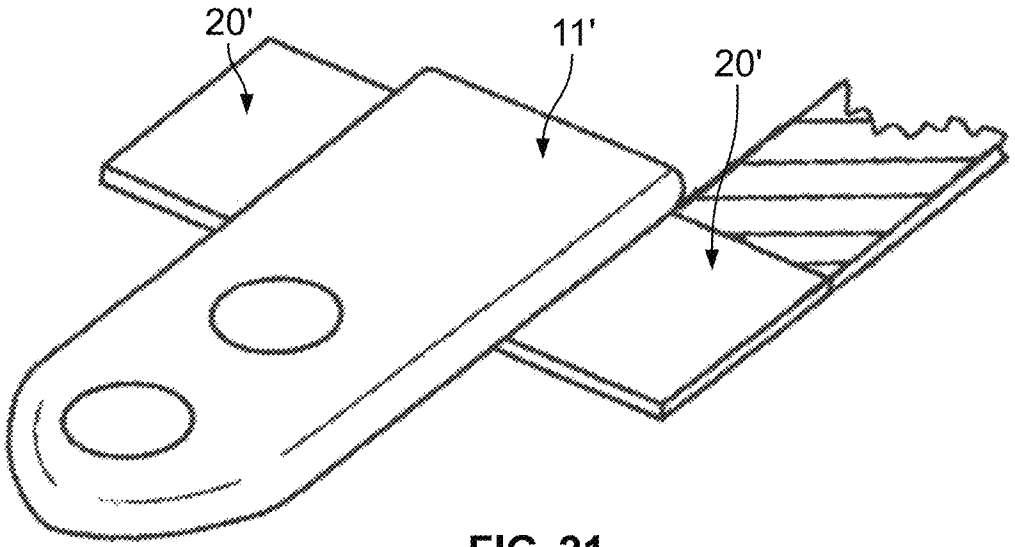
FIGS. 21 to 23 show perspective views of modified sheaths.
Figure 22:
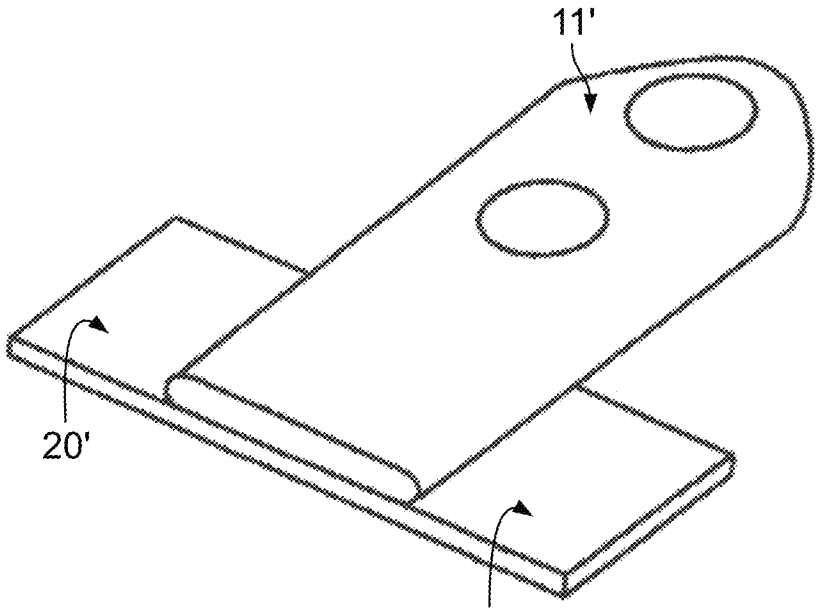

It should also be noted that the sheath 11' for the paper clip system can also be modified as needed, as shown by FIGS. 21 and 22. In order achieve a better support against the paper stack being held, the sheath 11' here is preferably provided with support surfaces 20' on both sides. These prevent the papers, which are held under the support surfaces between the sheath 11' and the loop of the respective paper clip there, from slipping out of the clip's grasp too easily.

The holding effect can be improved by means of a self-adhesive function provided on one or preferably more support surfaces or by means of a friction-increasing coating or fluting.

At least one support surface 20' can have an extension **20*' (as shown for example by FIG. 23**), which protrudes outward away from the tip, for example, and thus provides a tab that can be written upon, which facilitates clear organization of the papers that are held clipped by the system.

Figure 23:
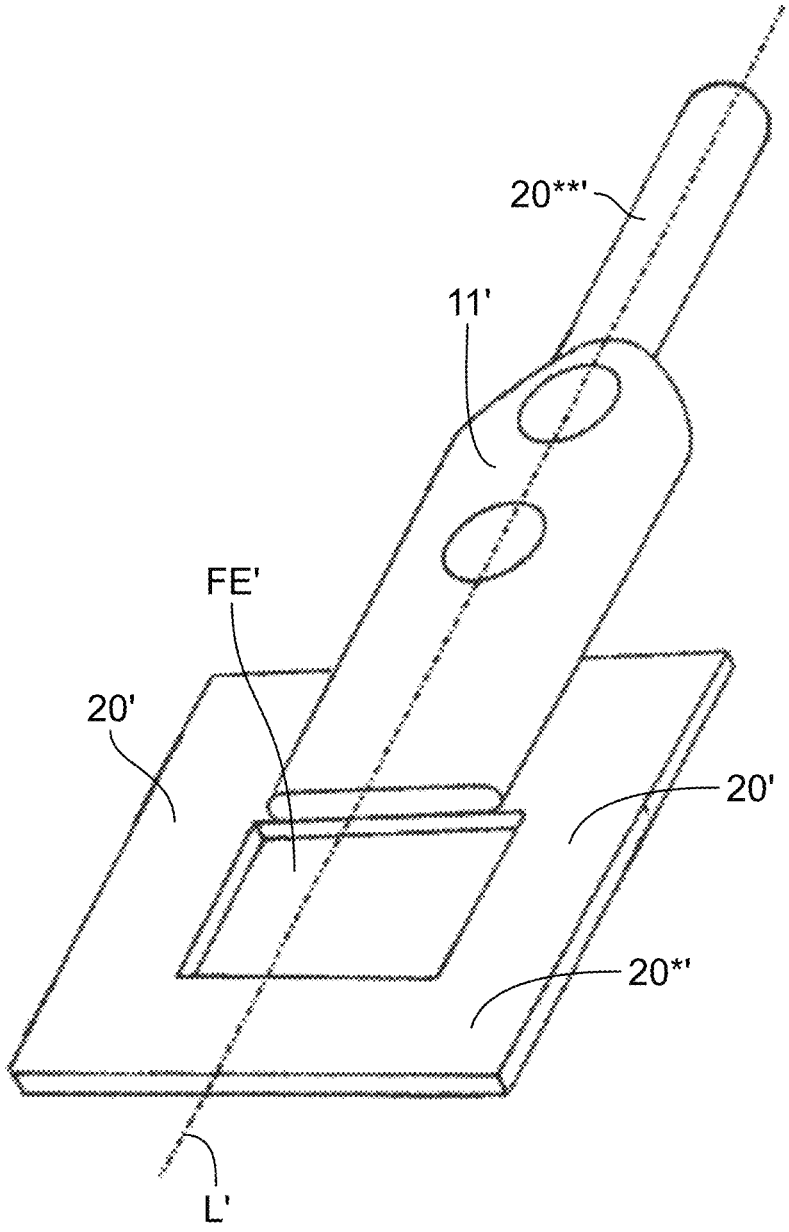

FIG. 23 shows another modification.

Here, too, the sheath 11' is provided along a part of its longitudinal narrow sides with support surfaces 20' that protrude beyond them and that serve the above-mentioned purpose.

As is readily apparent from FIG. 23, at the level of the insertion opening of the sheath 11', the support surfaces transition into an extension **20*', which, as has likewise already been explained above, protrudes outward in the form of a tab and is then available for organization of the clipped papers. It is worth noting that the extension 20*'** has a window FE' through which a leg of a paper clip belonging to the system can be slid into the region of the (lower here) outside of the large surface of the sheath.

The figures also clearly shows the optional pulling extension 20'**, which makes it much easier to pull on the sheath when a document that is clipped together with the system is to be removed.

Fifth Exemplary Embodiment

Figure 18:
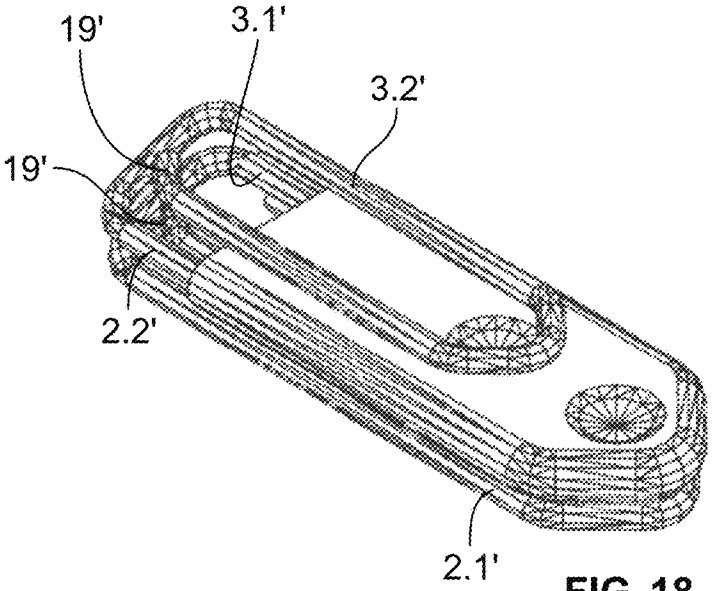
Figure 19:
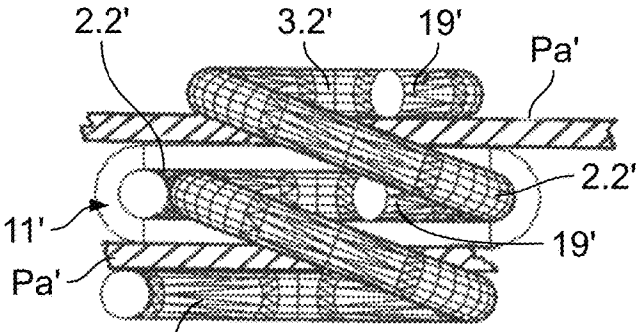
Figure 20:
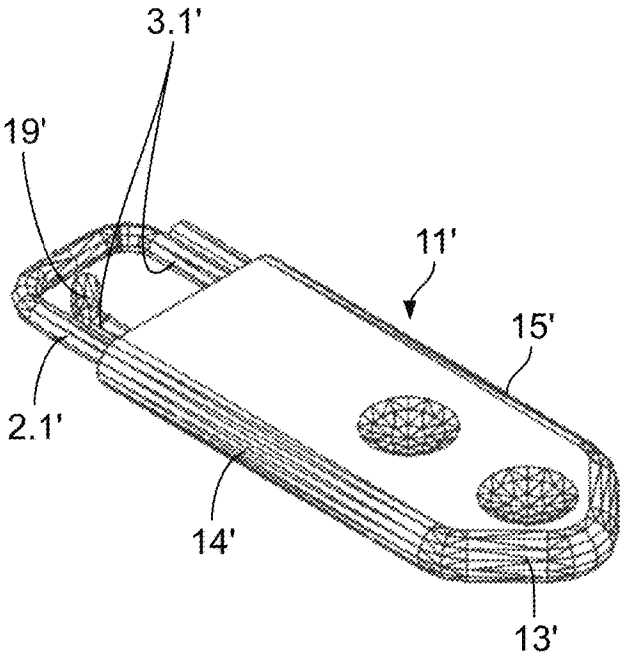

The fifth exemplary embodiment shown in FIGS. 18 to 20 is a slight modification of the fourth exemplary embodiment. Therefore statements made above with regard to the latter also apply without restriction to the fifth exemplary embodiment.

The modification consists of the fact that the free end of the small loop is bent inward slightly by preferably 30° to 60° and ideally by 45°+/−5°.

This is particularly visible from the small loop 3.1' in FIG. 20.

In this way, the free end forms a bend 19'. This bend 19' facilitates the detachment of the small loop of the first paper clip from the embrace of the large loop of the second paper clip, with which the first paper clip is inserted together into the sheath 11'. To this end, reference is made to FIG. 18 and FIG. 19, the latter showing the assembly from the open narrow end of the sheath 11'.

It should also be noted that the bend 19' can optionally also be in the exemplary embodiments to be explained below, which have a comparable free end on the small loop.

Sixth Exemplary Embodiment

Figure 24:
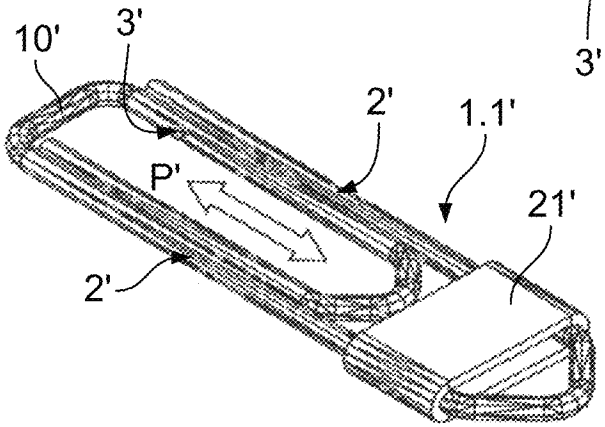
FIG. 24 shows a perspective view of the sixth exemplary embodiment.

FIG. 24 shows a sixth exemplary embodiment of the invention.

The sixth exemplary embodiment of the invention essentially corresponds to the fourth exemplary embodiment of the invention. Therefore statements made above with regard to the latter also apply here except for the following expressly explained differences.

There is the following difference as compared to the fourth exemplary embodiment:

In this exemplary embodiment, the sheath is embodied as reduced in size. This means that the connecting element no longer constitutes a complete sheath and is only represented by a holding ring 21' that is closed in the circumference direction and open at the two narrow ends. As is readily apparent, the holding ring 21' is secured to a second paper clip 1.1' in sliding fashion. The maximum span of its inner cross-section in two directions perpendicular to each other preferably corresponds essentially to [that of] the large loop of the paper clip so that the holding ring 21' can be slid back and forth on the large loop of the paper clip.

For this embodiment of the system according to the invention as well, preferably non-deformed paper clips are used, as has already been described above.

The assembly also takes place in the manner already described above as a preferred variant.

First is the arrangement shown in FIG. 24, in which the holding ring 21' is shown in the state in which it is slid onto a non-deformed paper clip.

Next, at least one piece of paper is clipped between the small loop 3' and the large loop 2'. As a result of this, the small loop 3' is moved elastically downward out of the region enclosed by the large loop 2' and is kept away from it by the paper (not shown in the drawing).

Then the holding ring 21' is slid in the direction of the arrow and its label P' further toward the other end of the paper clip. Then the small loop of a second paper clip is inserted into the region enclosed by the large loop of the first paper clip and through the inner cross-section of the holding ring 21'. In this case, its large loop comes to rest outside on or above the large surface of the holding ring 21'. As a result, this once again produces the system configuration explained above in the example of the sheath 11'.

To this extent, there is no difference relative to the tenth exemplary embodiment.

This in turn means that it is possible for one or more sheets of paper or similar items to be clipped between the small loop of the first paper clip and the holding ring 21'. This also means that it is likewise possible for one or more sheets of paper or similar items to be clipped between the large loop of the second paper clip and the holding ring 21'.

Seventh Exemplary Embodiment

Figure 25:
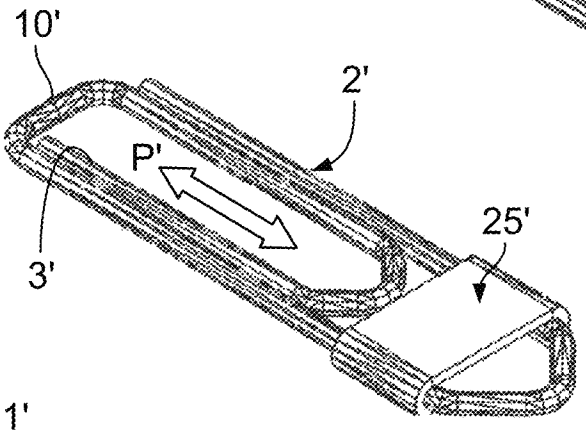
FIG. 25 shows a perspective view of the seventh exemplary embodiment.

FIG. 25 shows a seventh exemplary embodiment of the invention.

This exemplary embodiment corresponds essentially to the sixth exemplary embodiment so that statements made with regard to the latter, even including the back-references to the fourth exemplary embodiment, also apply here.

This exemplary embodiment differs from the sixth exemplary embodiment in that the holding ring 21' broken open and now represents only a C-shaped holder 25'.

The C-shaped holder 25' can be moved in the direction of the double arrow P' and can therefore be slid onto the paper clip in a direction in which holds together the two loops that have been inserted one inside the other of the paper clips involved in the system.

The holding action is less pronounced than in the embodiment according to FIG. 24, but can fulfill the requirements under certain circumstances.

Eighth Exemplary Embodiment

Figure 26:
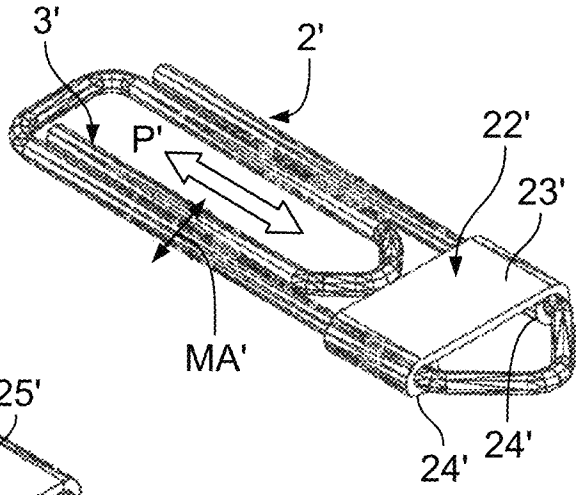
FIG. 26 shows a perspective view of the eighth exemplary embodiment.

FIG. 26 shows an eighth exemplary embodiment of the invention.

This exemplary embodiment corresponds essentially to the sixth exemplary embodiment so that statements made with regard to the latter, even including the back-references to the fourth exemplary embodiment, also apply here.

The eighth exemplary embodiment differs from the sixth exemplary embodiment in that the connecting element has been further reduced in size. The connecting element here is embodied in the form of a double claw 22', which consists of a main claw part 23', that bridges over the plane that one large loop defines between its two legs. The main claw part 23' is adjoined on both of its leg sides by claw-like wrap-arounds 24', which each grasp around a leg of a large loop. In this way, the double claw 22' is affixed to a large loop in captive, but movable fashion.

It is also noteworthy that in this exemplary embodiment, the respective paper clips have an additional plastic deformation and a special embodiment, which is likewise not graphically depicted in FIG. 26.

Specifically, the legs of the large loop and the small loop of a paper clip in this exemplary embodiment must maintain a certain minimum distance in the direction of the black arrow MA'. This ensures that the claw-like wrap-arounds 24' have the necessary room to be slid between the legs of a large loop and the legs of a small loop accommodated therein so that the double claw 22' can be slid into its holding position, which corresponds to the holding position of the above-mentioned holding ring 21'.

The function of the double claw 22' is the same as has been already described above for the holding ring 21', to which reference is hereby made.

Ninth Exemplary Embodiment

Figure 27:
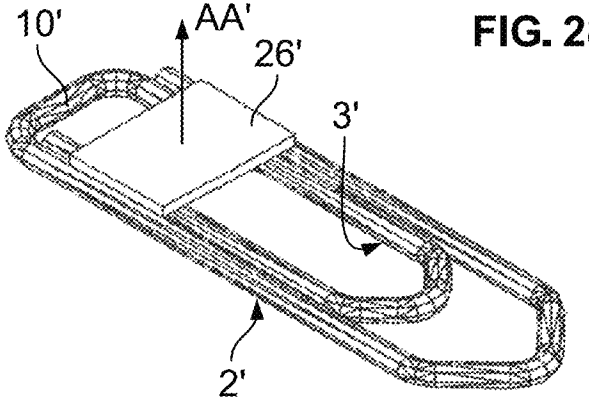
FIG. 27 shows a perspective view of the ninth exemplary embodiment.

FIG. 27 shows a ninth exemplary embodiment of the invention.

The ninth exemplary embodiment corresponds essentially to the seventh exemplary embodiment so that statements made with regard to the latter, including the back-references to other exemplary embodiments, also apply here.

The only difference lies in the fact that the connecting element is embodied differently.

The C-shaped holder of the seventh exemplary embodiment has namely been further reduced in size and now consists only of a plate 26', which has been connected, preferably welded, to at least one leg, or better still both legs of a large loop 2'.

Tenth Exemplary Embodiment

Figure 28:
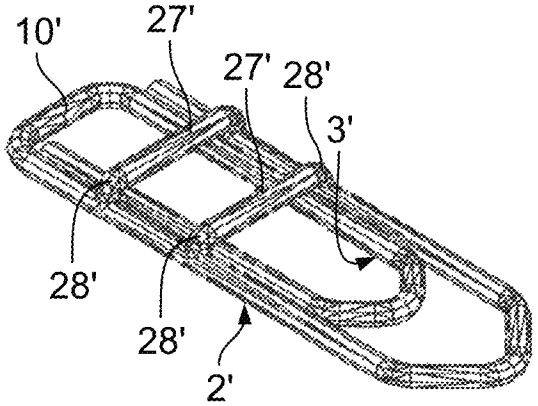
FIG. 28 shows a perspective view of the tenth exemplary embodiment.

FIG. 28 shows a tenth exemplary embodiment of the invention.

This tenth exemplary embodiment corresponds essentially to the ninth exemplary embodiment so that statements made with regard to the latter, including the back-references to other exemplary embodiments, also apply here.

The only difference lies in the fact that the connecting element is now no longer a plate, but instead is alternatively comprised only of preferably two, but possibly more, transverse brackets 27'.

The transverse brackets 27' ideally consist of the same wire as the paper clip itself.

The transverse brackets 27', as already described in the preceding exemplary embodiment for the plate, are fastened, preferably welded, to at least one leg, or better still both legs of the large loop of the paper clip.

The two transverse brackets preferably extend at an angle of 90° to the legs of the loops; an oblique position, however, is possible.

Eleventh Exemplary Embodiment

Figure 29:
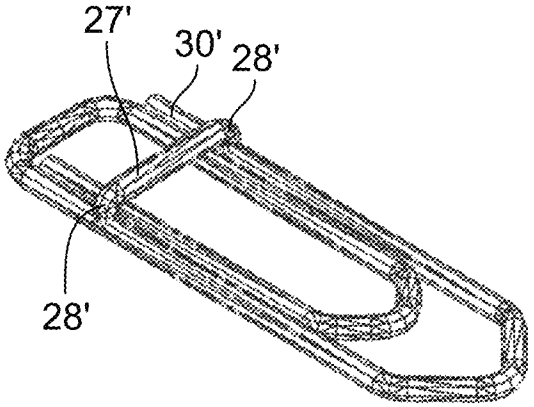
FIG. 29 shows a perspective view of the eleventh exemplary embodiment.

FIG. 29 shows an eleventh exemplary embodiment of the invention.

The eleventh exemplary embodiment corresponds essentially to the tenth exemplary embodiment so that statements made with regard to the latter, including the back-references to other exemplary embodiments, also apply here.

The difference between the eleventh exemplary embodiment and the tenth exemplary embodiment lies in the fact that in the eleventh exemplary embodiment, for reasons of facilitating material savings, only a single transverse bracket 27' is provided.

This is embodied in the same way as described for the transverse brackets 27' of the preceding exemplary embodiment.

Twelfth Exemplary Embodiment

Figure 30:
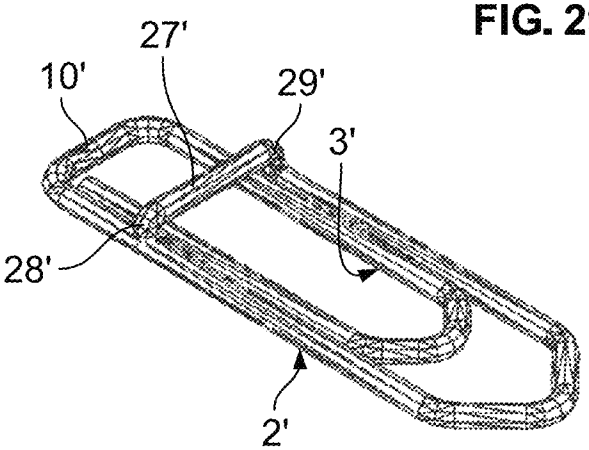
FIG. 30 shows a perspective view of the twelfth exemplary embodiment.

FIG. 30 shows the twelfth exemplary embodiment.

It is a particularly slight modification of the eleventh exemplary embodiment. Statements made with regard to the latter, including the back-references to other exemplary embodiments, also apply here.

In this exemplary embodiment, the free section 30' of the large loop 2', which in the eleventh exemplary embodiment is positioned between the transverse bracket 27' and the free end of the large loop 2', has been eliminated, i.e. it can no longer be found as such in the paper clip. Instead, it is an integral component of the transverse bracket 27', if the latter has been produced by the bending of the corresponding leg of the large loop of the paper clip.

This not only results in material savings, but also has the advantage that for the transverse bracket 27', preferably only one weld point 28' is required because the transverse bracket 27' has a bending point 29' on the opposite side, i.e. is an integral component of the corresponding leg of the large loop 2'. This makes the production more effective.

Thirteenth Exemplary Embodiment

Figure 31:
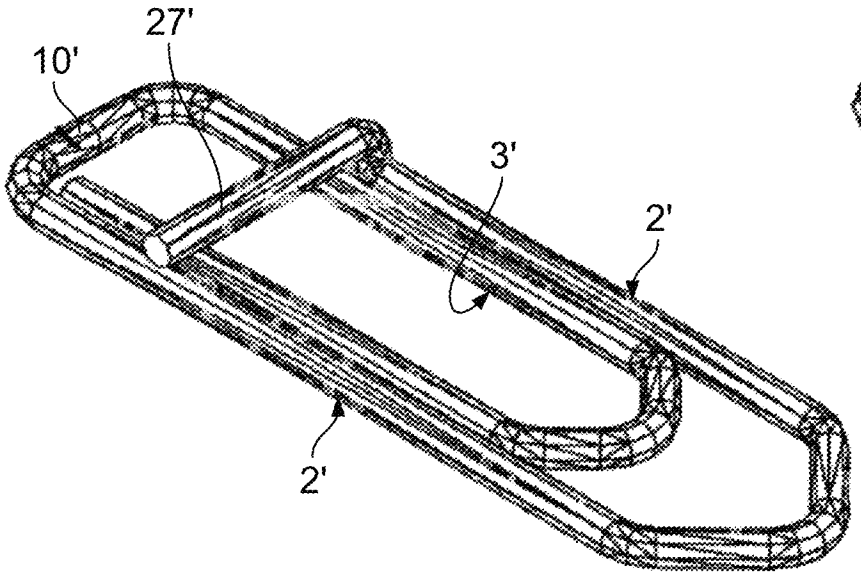
FIG. 31 shows a perspective view of the thirteenth exemplary embodiment.
Figure 35:
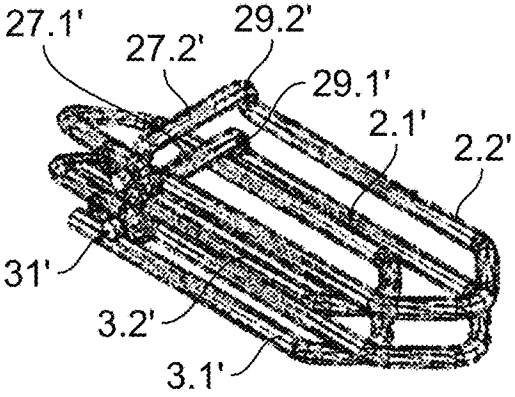
Figure 36:
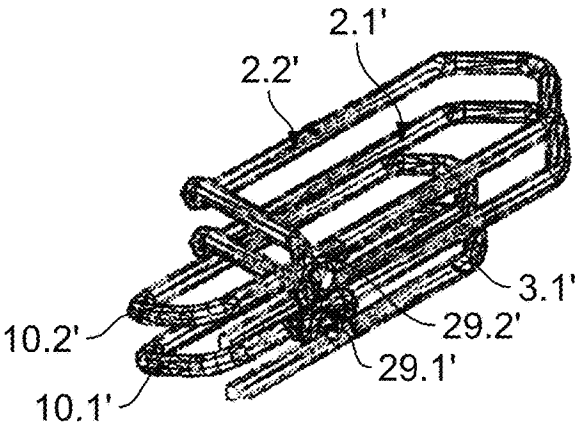

FIG. 31 shows a thirteenth exemplary embodiment of the invention.

This embodiment is a modification of the eleventh and twelfth exemplary embodiments. Statements made with regard to the latter, including the back-references to other exemplary embodiments, therefore also apply here.

In this exemplary embodiment, the transverse bracket 27' is connected only on one side, as already mentioned briefly above in the example of FIG. 27 for the plate 26'.

Preferably, it is an integral component of the free leg of the large loop 2'. In order to produce the transverse bracket 27' of the type in question here, the above-mentioned leg of the large loop 2' is simply embodied as somewhat longer and is then bent by at least 1×90°, preferably 2×90°, into the position shown in FIG. 31.

Here, too, an oblique course of the transverse bracket can be alternatively provided, as already mentioned above.

Fourteenth Exemplary Embodiment

Figure 32:
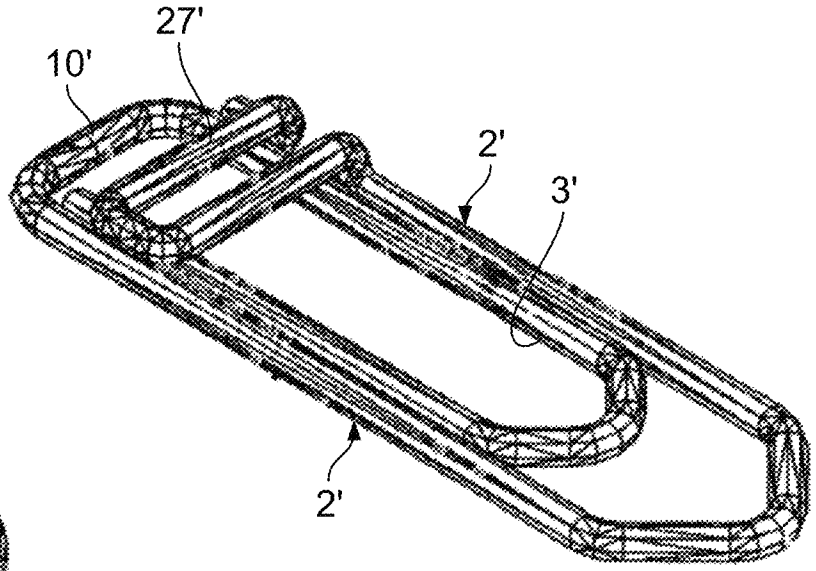
FIG. 32 shows a perspective view of the fourteenth exemplary embodiment.

FIG. 32 shows a fourteenth exemplary embodiment of the invention. It is a very slight modification of the thirteenth exemplary embodiment so that statements made above with regard to the latter also apply without restriction here.

The difference between the thirteenth and fourteenth exemplary embodiments consists of the fact that the transverse bracket 27' here is embodied as a multiple-bend section, which preferably has a U-shaped design, as shown in FIG. 32, or alternatively, has an essentially V-shaped design. A transverse bracket 27' embodied in this way provides a particularly large degree of hold.

Theoretically, the transverse bracket 27' could be embodied as a welded section, but ideally, is integrally joined from the outset to the free leg of the large loop 2' and comes into being through corresponding multiple bending.

Fifteenth Exemplary Embodiment

FIGS. 33 to 36 show a fifteenth exemplary embodiment of the invention.

Figure 34:
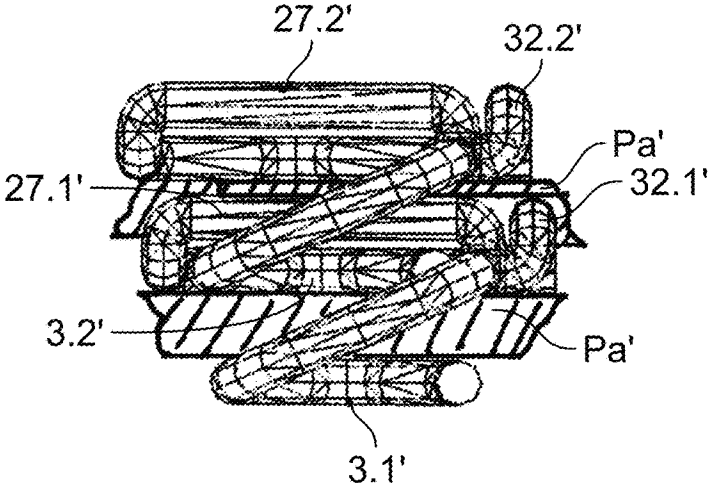

It should once again be noted that in this exemplary embodiment as well, non-deformed paper clips are used in the way that has already been described for the fourth exemplary embodiment, see FIG. 34.

This exemplary embodiment features the fact that it is particularly simple since it does not require any additional, separate connecting elements and it is also possible to eliminate costly weld points. Instead, the transverse bracket 27' in this case is an entirely integral component of a paper clip.

Figure 33:
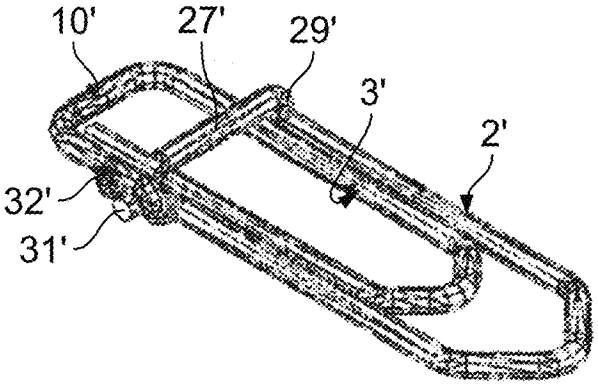

As is the most clearly visible from FIG. 33, in this case, a for example V-shaped or for example C-shaped detent recess 32' has been bent integrally into the one leg of the large loop 2' of a paper clip or has been stamped therein or produced therein by so-called "notching" or in German "Ausklinkung".

This detent recess 32' accommodates the end of the opposing leg of the large loop 2'.

For this purpose, the opposing leg of the large loop 2' has been embodied as longer and has been bent at the bending point 29' by for example 1×90° or preferably 2×90°, i.e. is guided transversely across the large loop. In this way, it forms a transverse bracket 27'.

The resulting transverse bracket 27' is provided with a bend 31' at its free end. The bend 31' is embodied so that it can be hooked into the detent recess 32' on the opposite leg of the large loop 2'.

This embodiment has particular advantages from a production engineering standpoint. Apart from an appropriately embodied wire bending and forming machine, nothing else is required for assembly and manufacturing.

An oblique course of the transverse bracket can also be alternatively provided, as already mentioned above.

Further Specific Exemplary Embodiments

Figure 39:
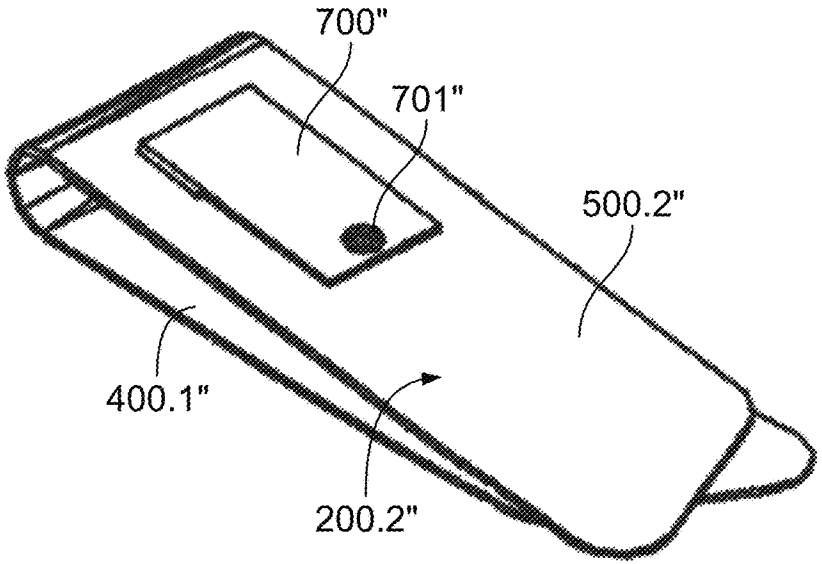
Figure 37:
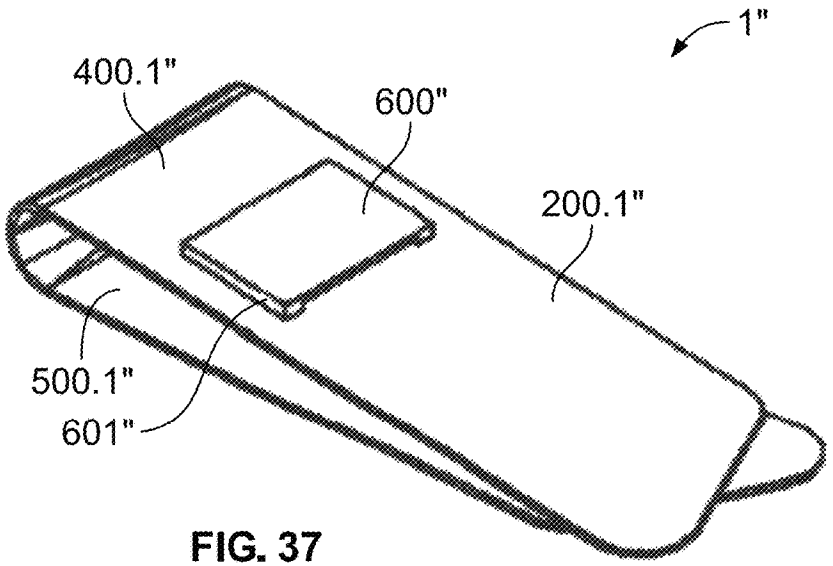

FIGS. 37 and 39 show another exemplary embodiment. This paper clip system can preferably be a paper clip system 1", which consists of a first paper clip 200.1" with a first tong part 400.1" and a second tong part 500.1". A second paper clip 200.2" with a first tong part 400.2" and a second tong part 500.2" then belongs to the paper clip system.

As is most clearly visible in FIG. 37, the first hooking device is embodied as a bracket 600" on the outside of a tong part 400.1", which has lateral limits 601" and in between them, has an open space between itself and the outer surface of the tong part. The attachment can be produced in the above-mentioned way by means of welding, soldering, gluing, etc.

As is most clearly visible in FIG. 39, the second hooking device can be embodied as a tongue 700" that is only attached at one end to the outside of a tong part 500.2" of another paper clip of the paper clip system. The statements above for the bracket apply correspondingly with regard to the fastening. The two paper clips can now be connected by sliding the tongue 700" between the bracket 600" and the tong part 400.1".

As is apparent, the tongue 700" is particularly preferably provided with a detent means 701", in this case, preferably in the form of a bowl-shaped impression. The detent mechanism prevents the tongue 700" from being inadvertently pulled out from the bracket 600" too easily.

It goes without saying that each paper clip of the system has a bracket 600" on its one tong part and a bracket 700" on its other tong part so that the paper clips of the paper clip system can be concatenated with or connected to one another in arbitrary fashion.

Figure 38:
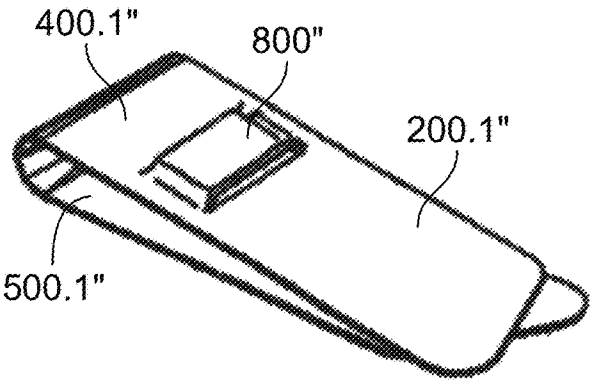

The embodiment of the hooking devices shown here is particularly advantageous, but can theoretically be varied, which is not shown here or is only indicated in passing in the figures. It is conceivable, instead of the bracket 600", to provide a bracket-like notch 800" in the corresponding tong part, particularly if it is made of metal, as is preferred. The tongue 700" can be inserted into the notch, whose function is comparable to that of the bracket. FIG. 38 illustrates what is meant by this.

Another alternative would be to equip at least one tong element with a self-adhesive coating on the outside, of the kind that is known, for example, from so-called sticky notes. The self-adhesive coating is to be understood as a hooking device in the sense of this invention, in connection with the glue-covered opposing surface of the other paper clip.

Theoretically, there are also other conceivable embodiment possibilities, for example in the form of a dovetail or T-groove extending transversely to the sliding-on direction on a tong section into which a fitting counterpart on the other tong section is slid.

The detent devices can also alternatively be replaced with magnet devices. Such a magnet device can be composed of a hard magnet, which is glued, soldered, welded or the like to a tong element, or which is stamped into the material of the tong element. The complementary magnet device can likewise consist of a hard magnet, preferably of different polarity, which is glued, soldered, welded, or the like to one tong element, or which is stamped into the material of the tong element. Alternatively, the complementary magnet device can instead consist of an—if need be appropriately fastened—soft magnetic material.

It should also be mentioned that the detent devices can alternatively also be replaced with hook-and-loop fasteners. For this purpose, it is possible, for example, for a burr element with hooks or hook tips to be provided on one tong element and for a loop element to be provided on the other tong element to produce the hook-and-loop fastening to the above-mentioned hook element, etc.

For the sake of completeness, it should be noted that it is particularly advantageous to also produce the tongue 700" by means of notching so that it is also produced of one piece/integrally with the tong element.

For the sake of completeness, it should be noted that the object of the invention can also include creating a paper clip system, which makes it possible to hold together different stacks of respectively associated papers without the occurrence of an unwanted catching and also creating a paper clip system that enables a simple and quick removal of paper clips from a storage box.

In addition to the subjects disclosed in the claims (individually and/or in combination), protection is also sought for the following subjects that have been separated into individual paragraphs.

A paper clip system wherein the inner cross-section of the sheath (11) essentially corresponds to a rectangle or an oval or an ellipse whose long sides (LS) or major axis (oval, ellipse) corresponds to the width of a large loop (2) of the paper clips belonging to the system (1) and whose short sides (KS) or minor axis (oval, ellipse) essentially corresponds to up to 2.5 times the diameter of the wires of the paper clips belonging to the system (1).

A paper clip system wherein the inner cross-section of the sheath (11) has an additional side length, which is preferably less than ¼ the maximum distance that the wires—which form the legs of a large loop (2) in a paper clip (1) belonging to the system—assume relative to each other.

A paper clip system wherein the interior encompassed by the sheath (11) is divided into two chambers by a dividing wall inside the tube, of which one chamber accommodates a loop of a paper clip (1).

A paper clip system wherein the two chambers are situated next to each other in that their narrow sides (KS) are immediately adjacent.

A paper clip system wherein the two chambers are positioned one on top of the other in that they are immediately adjacent to each other with their long sides (LS).

A paper clip system wherein at the end, the sheath (11) has a single bevel (17) on a large surface (16) and at the opposite end, on the large surface diametrically opposed to this one, has a double bevel (18).

A paper clip system wherein the total length of the tongue (20*a*) and the sheath (11) in the direction of the longitudinal axis (L) of the tube is greater than the largest span of the paper clips belonging to the system (1).

A paper clip system wherein at least one surface of the sheath (11) and/or of the at least one fin (20) and/or the tongue (20*a*) can be printed on, written on, or have glue applied to it.

A paper clip system wherein the paper clip system additionally comprises removal tongs for grasping and removing a sheath (11).

A paper clip system wherein the sheaths (11) have a profiling for the form-fitting placement of the removal tongs.

A paper clip system wherein at least on one of its large surfaces (16'), the sheath (11') preferably has an inward-protruding detent mechanism (17, 18'), which is embodied so that the detent mechanism (17, 18') engages in detent fashion with the small loop (3') of the paper clip that is inserted all the way into the sheath (11') and secures the small loop (3') from being inadvertently pulled out of the sheath (11').

A paper clip system wherein on at least one of its large surfaces (16'), the sheath (11') has an inward-protruding detent mechanism (17, 18'), which is embodied so that the detent mechanism (17, 18') engages in detent fashion with the large loop (2') of the paper clip that is inserted all the way into the sheath (11') and secures the large loop (2') from being inadvertently pulled out of the sheath (11').

A paper clip system wherein on at least one of its large surfaces (16'), the sheath (11') is equipped with an adhesive layer, preferably so that the adhesive layer can be made ready to glue by removing a protective film.

A paper clip system wherein the sheath (11') is provided with support surfaces (20')—preferably extending on both sides from its longitudinal narrow sides (14, 15').

A paper clip (1') wherein the sheath (11') has an extension (**20*'**), which, in the direction of its longitudinal axis, extends beyond its narrow end serving as an insertion opening and preferably serves as a tab that can be written on, have glue applied to it, or be printed on.

A paper clip system wherein the extension (**20*') transitions smoothly into at least one, or better still two, support surfaces 20**.

A paper clip system wherein the extension (**20*') has a window (FE'), which permits it to slide the leg of a paper clip (1') belonging to the system through the window (FE') into the region of the outside of a large surface (16') of the sheath (11'**).

A paper clip (1') wherein the sheath (11'), which is open at one or both of the narrow ends, at the narrow end that accommodates the tips of the paper clips (1'), has a pulling extension (20'), which can be used to pull the sheath (11') off of the paper clips (1'**).

A paper clip system wherein a for example V-shaped or for example C-shaped detent recess (32') has been bent integrally into the one leg of the large loop (2') of a paper clip or has been stamped therein or produced therein by so-called "notching" and this detent recess (32') accommodates the end of the opposing leg of the large loop (2'), wherein the opposing leg of the large loop (2') is embodied as longer and at the bending point (29'), is bent by approximately 90° so that it extends transversely across the large loop (2') and forms a transverse bracket (27'), wherein at its free end, the formed transverse bracket (27') is preferably provided with a bend (31') and the transverse bracket (27') or its bend (31') is embodied so that in the completely assembled state, it is into the detent recess (32') on the opposite leg of the large loop (2').

A paper clip system wherein the sheath (11') is a one-piece plastic part.

A paper clip system wherein opposite form its open first narrow end (12'), the sheath (11') has a second, closed narrow end (13'), which on its interior, forms an inner cross-section that provides a hold for the tip (5') of the paper clip (which tip is opposite from the connecting section between the large loop (2') and the small loop (3') of a paper clip).

A paper clip system wherein the sheath (11') is printed on at least one of its large surfaces (16').

A paper clip system wherein the connecting element is embodied as a C-shaped holder (25'), which is slid onto a large loop (2') of a paper clip.

A paper clip system wherein the connecting element is embodied as a plate (26'), which has been connected, for example welded, to the two legs (4, 6') of a large loop (2').

A paper clip system wherein the connecting element is formed by preferably two, but possibly more, transverse brackets (27'), wherein each respective transverse bracket can be embodied as double-stranded so that it is U-shaped or V-shaped.

A paper clip system wherein the connecting element is formed by a single transverse bracket (27').

A paper clip system wherein the transverse brackets (27') consist of the same wire as the paper clip (1') itself.

A paper clip system wherein the free section (30') of the large loop (2') in the region between the transverse bracket (27') and the free end of the large loop (2') is eliminated.

A paper clip system consisting of at least two paper clips (1), each with a large loop (2) and small loop (3), which is positioned in the inner region enclosed by the large loop, and at least one connecting element (11*), wherein the connecting element (11*) is a plate with two holding sections that are preferably offset from each other by approximately one wire thickness, each of which sections is embodied as a large surface (16) with two flat sides, onto which one of the loops of each of the two paper clips (1) is slid in such a way that the connecting element (11*) holds the two paper clips (1) in position so that their other loop is ready to clip an item that is to be held between it and the outer surface of the large surface facing it.

The invention claimed is:

1. A paper clip system comprising; at least two paper clips positioned directly on top of each other, each paper clip having a large loop and a small loop that is positioned in the inner region enclosed by the large loop, wherein the paper clips are separable from one another, and a connecting element which holds the small loop of one paper clip in the inner region enclosed by the large loop of the another paper clip, wherein the small loop of the one paper clip is in the same plane as the large loop of the other paper clip, and wherein on one side of the loops of the two paper clips positioned one inside the other by the connecting element, across their longitudinal broad side, there is a free large loop of the one paper clip, and on the other side of the loops of the two paper clips positioned one inside the other by the connecting element, across their longitudinal broad side, there is a free small loop of the other paper clip, wherein the connecting element is embodied as a plate, which has been connected to both legs of the large loop.

2. The paper clip system of claim 1, wherein the connecting element is a sheath with two flat large surfaces into which one of the loops of each of the two paper clips is slid such that the sheath holds the two paper clips in position with the other free loops of the two paper clips ready to clip an item that is to be held between a respective free loop and the outer surface of the large surface of the sheath facing the respective free loop.

3. The paper clip system of claim 2, wherein the sheath is open at both of its narrow ends.

4. The paper clip system of claim 2, wherein the sheath is a flexible tube segment.

5. The paper clip system of claim 2, wherein the inner cross-section of the sheath is dimensioned and embodied such that two loops of two different paper clips can be accommodated independently of each other in the sheath without one loop having to be inserted into the inner region enclosed by the other loop.

6. The paper clip system of claim 2, wherein at the end on at least one large surface, the sheath has a single bevel.

7. The paper clip system of claim 2, wherein at the end on at least one large surface, the sheath has a double bevel.

8. The paper clip system of claim 2, wherein the sheath has a tongue, which protrudes from the sheath in the direction of the longitudinal axis (L) of the sheath.

9. The paper clip system of claim 2, wherein the sheath has at least one wing, which extend(s) away from the sheath in a direction transverse to the longitudinal axis (L) of the sheath.

10. The paper clip system of claim 1, wherein the connecting element is a sheath into which the large loop of the one paper clip, together with the small loop of the other paper clip that is positioned in the inner region that is enclosed thereby, is inserted through an open first narrow end of the sheath.

11. The paper clip system of claim 10, wherein the inner cross-section of the sheath is embodied such that the large loop of the paper clip inserted into the sheath, at least in the region of the tip of the large loop, rests with frictional engagement internally against the longitudinal narrow sides of the sheath and/or rests with frictional engagement internally against the longitudinal broad sides of the sheath.

12. The paper clip system of claim 10, wherein opposite from its open first narrow end, the sheath has a second, likewise open narrow end.

13. The paper clip system of claim 1, wherein the free end of the small loop is bent slightly inward and thus forms a bend.

14. The paper clip system of claim 1, wherein the connecting element is embodied in the form of a double claw, which consists of a main claw part that bridges over the plane that one large loop defines between its two legs; the main claw part is adjoined on both leg sides by wrap-arounds that each grasp around a leg of a large loop.

* * * * *